US008032993B2

(12) United States Patent
Musal

(10) Patent No.: US 8,032,993 B2
(45) Date of Patent: Oct. 11, 2011

(54) ADJUSTMENT MECHANISM

(75) Inventor: Michael J. Musal, Soquel, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 485 days.

(21) Appl. No.: 12/350,632

(22) Filed: Jan. 8, 2009

(65) Prior Publication Data

US 2010/0170068 A1 Jul. 8, 2010

(51) Int. Cl.

| | |
|---|---|
| ***A42B 3/04*** | (2006.01) |
| ***A42B 3/14*** | (2006.01) |
| ***A42B 1/22*** | (2006.01) |
| ***A44B 99/00*** | (2010.01) |

(52) U.S. Cl. ..... 24/68 B; 24/68 SK; 24/71.1; 2/418; 36/50.1; 36/50.5

(58) Field of Classification Search ..... 24/68 B, 24/68 SK, 71.1; 74/89.17, 422, 109, 89.18; 254/95, 96, 97, 98, 108; 269/202, 194; 2/417, 2/418; 221/151, 152; 292/32, 39, 142, 279, 292/257; 206/528; 215/201, 202, 208, 214, 215/216, 330, 331; 36/50.1, 50.5
See application file for complete search history.

(56) References Cited

U.S. PATENT DOCUMENTS

| | | | | |
|---|---|---|---|---|
| 2,205,741 | A * | 6/1940 | Bowers | 2/8.1 |
| 2,926,406 | A * | 3/1960 | Edwards et al. | 24/68 B |
| 3,214,809 | A * | 11/1965 | Edwards | 24/68 B |
| 3,325,824 | A * | 6/1967 | Donegan | 2/8.1 |
| 3,738,027 | A | 6/1973 | Schoch | |
| 3,808,644 | A | 5/1974 | Schoch | |
| 4,433,456 | A | 2/1984 | Baggio | |
| 4,516,442 | A * | 5/1985 | Davis | 74/529 |
| 4,616,524 | A | 10/1986 | Bidoia | |
| 4,660,300 | A | 4/1987 | Morell et al. | |
| 4,748,726 | A | 6/1988 | Schoch | |
| 4,761,859 | A | 8/1988 | Calabrigo | |
| 4,787,124 | A | 11/1988 | Pozzobon et al. | |
| 4,796,829 | A | 1/1989 | Pozzobon et al. | |
| 4,841,649 | A | 6/1989 | Baggio et al. | |
| 4,884,760 | A | 12/1989 | Baggio et al. | |
| 4,916,836 | A | 4/1990 | Baggio et al. | |
| 4,961,544 | A | 10/1990 | Bidoia | |
| 5,001,817 | A | 3/1991 | De Bortoli et al. | |
| 5,042,177 | A | 8/1991 | Schoch | |

(Continued)

FOREIGN PATENT DOCUMENTS

| | | |
|---|---|---|
| EP | 0264712 A2 | 10/1987 |

(Continued)

*Primary Examiner* — Robert Sandy
*Assistant Examiner* — Abigail E Morrell
(74) *Attorney, Agent, or Firm* — Baker Botts L.L.P.

(57) ABSTRACT

An adjustment mechanism comprises a dial comprising an inner wall defining a hole passing through the dial, the inner wall comprising a ledge having one or more cutouts. The mechanism further comprises a base comprising a first set of teeth and an actuator comprising a second, the second set of teeth configured to engage the first set of teeth and allow the actuator to be rotated in a first direction but not in a second opposite direction. The actuator further comprises one or more drive-dogs configured to engage a cutout on the inner wall of the dial, each drive-dog comprising a ramped edge configured to disengage the drive-dog from the cutout and lift the second set of teeth from the first set of teeth when the dial is rotated in the second direction.

22 Claims, 6 Drawing Sheets

U.S. PATENT DOCUMENTS 5,060,403 A 10/1991 Battistella et al.
5,062,225 A 11/1991 Gorza
5,065,480 A 11/1991 De Bortoli
5,065,481 A 11/1991 Walkhoff
5,065,532 A 11/1991 Gorza
5,083,348 A 1/1992 Gorza et al.
5,119,516 A 6/1992 Broersma
5,150,537 A 9/1992 Tacchetto et al.
5,152,038 A 10/1992 Schoch
5,157,813 A 10/1992 Carroll
5,158,559 A 10/1992 Pozzobon et al.
5,160,159 A 11/1992 Gorza et al.
5,269,621 A 12/1993 De Bortoli et al.
5,325,613 A 7/1994 Sussmann
5,357,654 A * 10/1994 Hsing-Chi ..... 24/68 B
5,366,232 A 11/1994 Pozzobon et al.
5,381,560 A 1/1995 Halstead
5,450,631 A 9/1995 Egger
5,526,555 A 6/1996 Battistella et al.
5,553,361 A 9/1996 Tacchetto et al.
5,592,722 A 1/1997 Foscaro et al.
5,600,874 A 2/1997 Jungkind
5,606,778 A 3/1997 Jungkind
5,638,588 A 6/1997 Jungkind
5,651,145 A 7/1997 Egger
5,669,116 A 9/1997 Jungkind
5,687,460 A 11/1997 Foffano et al.
5,715,582 A 2/1998 Zorzi
5,745,924 A 5/1998 Egger
5,794,272 A 8/1998 Workman et al.
5,934,599 A 8/1999 Hammerslag
5,996,256 A 12/1999 Zebe, Jr.
6,055,675 A 5/2000 Egger et al.
6,105,176 A 8/2000 Egger
6,202,953 B1 3/2001 Hammerslag
6,226,802 B1 5/2001 Sasaki et al.
6,289,558 B1 9/2001 Hammerslag
6,314,588 B1 * 11/2001 Fang ..... 2/418
6,708,376 B1 * 3/2004 Landry ..... 24/68 R
7,000,262 B2 * 2/2006 Bielefeld ..... 2/418
7,043,772 B2 * 5/2006 Bielefeld et al. ..... 2/418
7,076,843 B2 * 7/2006 Sakabayashi ..... 24/68 SK
7,174,575 B1 * 2/2007 Scherer ..... 2/418
7,203,972 B2 4/2007 Pietrzak et al.
7,222,374 B2 * 5/2007 Musal et al. ..... 2/421
7,565,704 B2 * 7/2009 Wu ..... 2/418
7,584,528 B2 * 9/2009 Hu ..... 24/68 SK
7,591,050 B2 * 9/2009 Hammerslag ..... 24/68 SK
7,707,695 B2 * 5/2010 Dubois ..... 24/68 B
2006/0248630 A1 11/2006 Bullock et al.
2007/0277295 A1 12/2007 Bullock
2007/0277296 A1 12/2007 Bullock

FOREIGN PATENT DOCUMENTS

EP 0264712 A3 10/1987

* cited by examiner

ADJUSTMENT MECHANISM

TECHNICAL FIELD

This disclosure relates in general to fit systems and more particularly to an adjustable mechanism for tightening and loosening fit.

OVERVIEW

Adjustment mechanisms may be used to adjust fit in a variety of clothing or sporting goods equipment and apparel. Protective headgear, such as helmets, are often used in activities, such as bicycling, skateboarding, motor sports, rock climbing, snowboarding, and skiing. Boots, shoes, or other athletic equipment may be used in some activities, such as skiing and skating. An adjustment mechanism may be used to adjust the fit of the equipment. Protective headgear is designed to maintain its structural integrity and stay secured to the head of a wearer, while protecting the wearer from a trauma to the head. Other equipment, such as footwear, skis, or snowboards, may provide protection and/or functionality. An adjustment mechanism may be used to tailor the fit of the equipment to the size and shape of the user.

SUMMARY OF EXAMPLE EMBODIMENTS

In accordance with one embodiment of the present disclosure, an adjustment mechanism comprises a generally cylindrical dial comprising an inner wall defining a hole passing through the dial, the inner wall comprising a ledge having one or more cutouts. The mechanism further comprises a base comprising a first set of teeth. The mechanism also comprises an actuator comprising a second set of teeth, the second set of teeth configured to engage the first set of teeth and allow the actuator to be rotated in a first direction but not in a second opposite direction. The actuator further comprises one or more drive-dogs, each drive-dog configured to engage a cutout on the inner wall of the dial, each drive-dog comprising a ramped edge configured to disengage the drive-dog from the cutout and to lift the second set of teeth of the actuator from the first set of teeth of the base when the dial is rotated in the second direction.

In accordance with another embodiment of the present disclosure, an adjustment mechanism comprises a generally cylindrical dial comprising an inner wall defining a hole passing through the dial, the inner wall comprising a ledge having one or more cutouts. The mechanism further comprises a base comprising a first set of teeth. The mechanism also comprises a cylindrical shuttle comprising a second set of teeth, the second set of teeth configured to engage the first set of teeth of the base and allow an actuator coupled to the shuttle to be rotated in a first direction but not in a second opposite direction. The shuttle further comprises one or more drive-dogs, each drive-dog configured to engage a cutout on the inner wall of the dial, each drive-dog comprising a ramped edge configured to disengage the drive-dog from the cutout and to lift the second set of teeth of the shuttle from the first set of teeth of the base when the dial is rotated in the second direction.

Numerous technical advantages are provided according to various embodiments of the present disclosure. Particular embodiments of the disclosure may exhibit none, some, or all of the following advantages depending on the implementation. In certain embodiments, the adjustment mechanism can allow for tightening and/or loosening the fit with only one hand. The adjustment mechanism may also be used in a variety of applications and provide for one-handed tightening and loosening in those applications. In addition, in some embodiments a single dial may be used to both tighten the mechanism by rotation in one direction and loosen the mechanism by rotation in a second direction. Further technical advantages include the ability to incrementally reduce the tension when loosening the dial by providing retention of the dial at the stopping point.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

Figure 1:
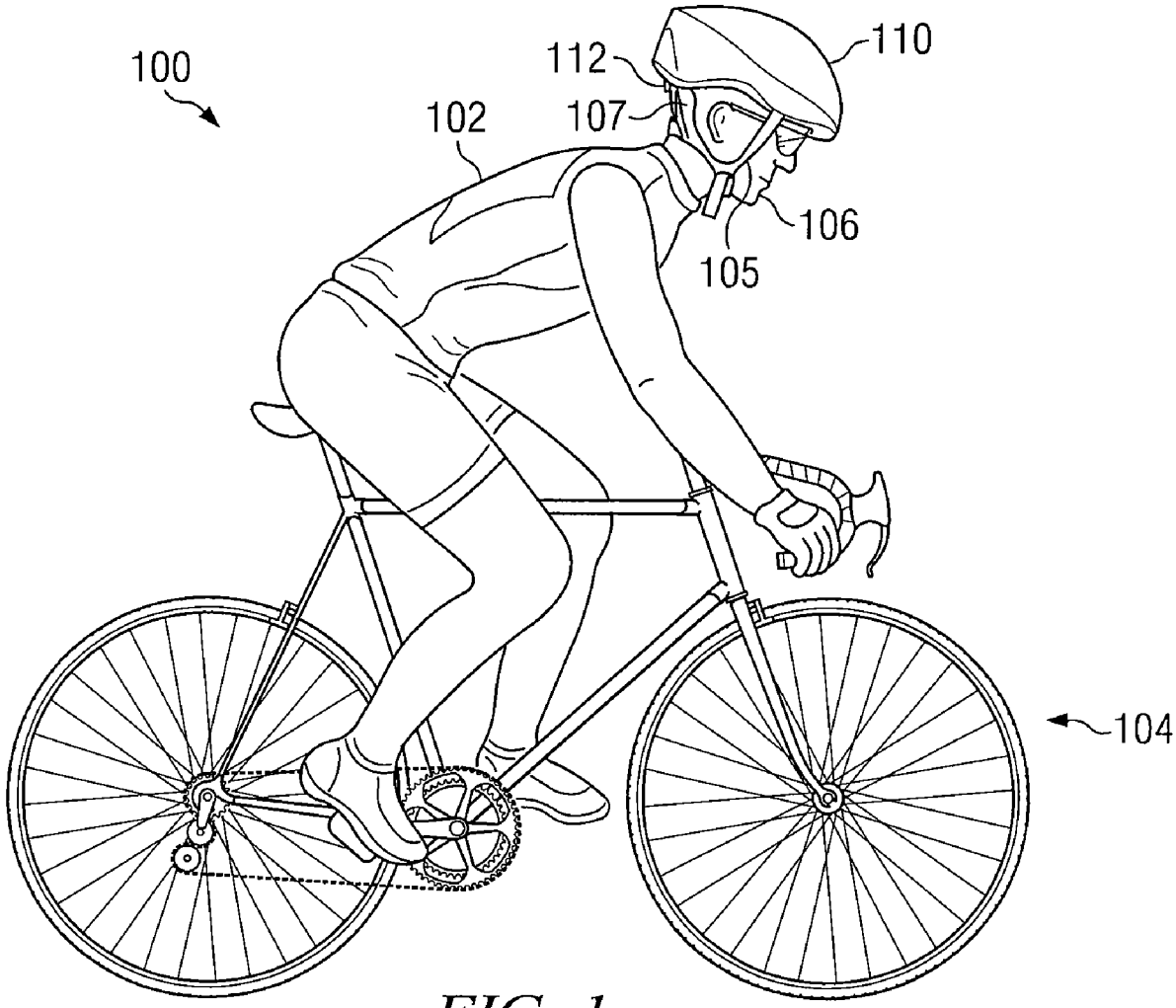
FIG. 1 illustrates one embodiment in which a helmet having a fit system in accordance with one example embodiment may be used.

Adjustment mechanisms can be used to adjust the fit or tension of a variety of items, such as helmets, boots, shoes, or other sporting and non-sporting equipment. Some adjustment mechanisms may require a user to remove the equipment to make the adjustment, and some may require a user to use two hands to adjust the equipment. In addition, some equipment may use different mechanisms or methods for tightening and loosening the adjustment mechanism. Other adjustment mechanisms may reduce tension by first releasing tension completely and then resetting the mechanism to the new tension point. In certain embodiments of the present disclosure, an adjustment mechanism is configured to tighten and/or loosen a rack and pinion of a fit system of a device, such as a helmet or shoe, with a rotation of a dial of the adjustment mechanism. Rotating the dial in a first direction can tighten the rack, which can tighten the fit of the equipment utilizing the adjustment mechanism. The adjustment mechanism may also comprise teeth configured to prevent the mechanism from slipping and loosening the adjustment mechanism when the user wants it to remain tight. Rotating the dial in a second direction can loosen the adjustment mechanism by raising the pinion away from a set of teeth configured to retain the pinion and prevent its rotation in the second direction. The pinion is then operable to rotate in the second direction and loosen the rack, which can loosen the fit system. The fit system could be loosened and/or tightened incrementally proportionate to the distance the dial is rotated, with the fit being retained when the dial stops rotating. In some embodiments, the dial can be rotated with one hand to tighten and/or loosen the fit system. Fit can also be adjusted while the user is wearing the equipment in some embodiments.

In other embodiments of the present disclosure, an adjustment mechanism may be configured to tighten and/or loosen a cable and drum of a fit system of a device with a rotation of a dial of the adjustment mechanism. Rotating the dial in a first direction can wind one or more cables around a drum, which can tighten the fit of the equipment utilizing the adjustment mechanism. The adjustment mechanism may also comprise teeth configured to prevent the mechanism from slipping and loosening the adjustment mechanism when the user wants it to remain tight. Rotating the dial in a second direction can loosen the adjustment mechanism by raising the drum away from a set of teeth configured to retain the drum and prevent its rotation in the second direction. The drum is then operable to rotate in the second direction and unwind one or more cables from the drum, which can loosen the fit system. The adjustment mechanism may be loosened and/or tightened incrementally proportionate to the amount of rotation of the dial.

In other embodiments, an adjustment mechanism may tighten and/or loosen a capstan, a band and drum, a worm and gear, a screw and nut, or any other suitable mechanism. Some embodiments described in this disclosure will illustrate an adjustment mechanism utilizing a rack and pinion, although other mechanisms may be used and still fall within the scope of this disclosure.

FIG. 1 illustrates one embodiment 100 in which a helmet comprises an adjustment mechanism 112 in accordance with one example embodiment. Environment 100 includes a bicyclist (user) 102 riding a bicycle 104 and wearing helmet 110. As used herein, the term "helmet" may refer to any type of protective headgear, such as, for example, a bicycle helmet, a motorcycle helmet, or a hardhat. In this embodiment, adjustment mechanism 112 is configured to operate on a helmet; however, adjustment mechanism 112 may be used in a variety of other applications, such as shoes, sporting equipment, or any other suitable application. In the illustrated embodiment, helmet 110 is secured to the head 106 of user 102 using one or more straps 105 and/or 107. The straps 105 and/or 107, along with certain other devices having a primary function of securing helmet 110 to the head 106 of user 102, may generally be referred to as a retention system. Adjustment mechanism 112 and arms 108 attached to adjustment mechanism 112 (described below) may be referred to as a fit system. In this disclosure, either of the retention system or the fit system, or a combination of components of the systems, may be referred to as a fit system. A fit system may be configured, in various embodiments, to adjust the fit of a helmet, shoe, or other equipment, and this adjustment may also affect the retention of the system. In this embodiment, the fit system may be adjusted by adjustment mechanism 112. The fit system may be tightened or loosened by adjustment mechanism 112. The fit system may also be tightened or loosened incrementally, with retention of the fit at any stopping point.

If user 102 were to accidentally fall off bicycle 104, user 102 could suffer various injuries, including head trauma. Accordingly, helmet 110 may generally be designed to both remain secured to head 106 and maintain its structural integrity to protect head 106 during an impact. Additionally, for certain uses, such as racing, helmet 110 may be designed such that it provides a high degree of protection while remaining both lightweight and aerodynamic.

The proper fitting and positioning of helmet 110 may maximize the level of comfort and protection offered to user 102 during an accident. To properly position and fit a helmet to the various head shapes and head sizes of potential users, adjustment mechanism 112 may be used. Conventional fit systems generally include a belt, or some form of a strap, that fits around the circumference of a user's head. Such fit systems may also include a component that is intended to engage the occipital region on the backside of the user's head. Engaging the occipital region may advantageously secure and position a helmet such that it may absorb a maximum amount shock during an accident.

Conventional adjustment mechanisms may be difficult to adjust for a user. For example, some adjustment mechanisms may require a user to remove the helmet to adjust the fit. In addition, some adjustment mechanisms may require the use of two hands for the user to make an adjustment. Moreover, adjustment mechanisms for certain helmets may not be capable of adjustment independently from other portions of the fit system, like retention straps. Such designs may limit the ability of a user to properly position and secure a helmet to his/her head, or to position and secure other equipment. Conventional adjustment mechanisms may also not provide for incremental tightening or loosening of fit with retention at any stopping point. These adjustment mechanisms could require tension to be mostly or completely released prior to adjusting the fit.

Figure 2:
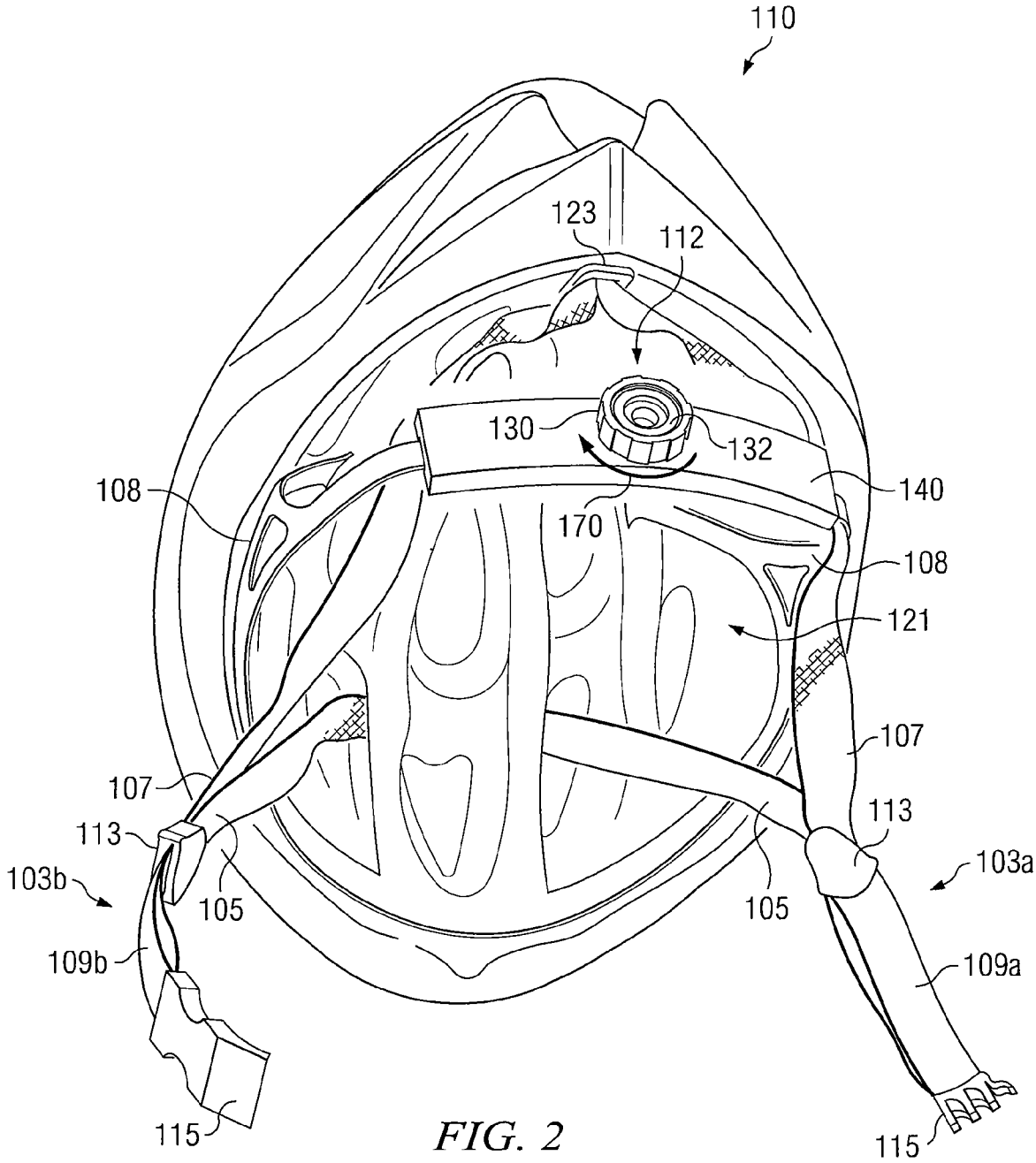
FIG. 2 illustrates one view of a helmet utilizing a fit system in accordance with one example embodiment.

FIG. 2 illustrates one view of a helmet 110 utilizing an adjustment mechanism 112 in accordance with one example embodiment. In FIGS. 1-6, like numbers refer to like components. Variations of adjustment mechanism 112 may be used in other applications, such as ski boots, shoes, or other equipment besides helmets. In the illustrated embodiments, components of adjustment mechanism 112 may be comprised of any suitable material and may be configured in any suitable manner.

Adjustment mechanism 112 comprises dial 130, actuator 132, and base 140. Other components of adjustment mechanism 112 may be obscured or partially obscured in this figure. Arms 108 are also shown in FIG. 2. Adjustment mechanism 112 is configured to tighten and/or loosen a fit system by tightening or loosening arms 108 in this embodiment.

Base 140 may comprise any suitable size, shape, or material configured to house and/or support one or more components of adjustment mechanism 112. Base 140 may be made of a durable plastic when utilized in a bicycle helmet, but may be another material in other embodiments. In this embodiment, base 140 encloses a rack (not shown) configured to engage actuator 132, which in this example embodiment is configured to operate as a pinion in a rack and pinion system. To operate as a pinion, actuator 132 can comprise a set of teeth suitable to engage a rack. The rack may also be coupled to arms 108 or formed as part of arms 108 that extend from each side of base 140. Arms 108 may be attached to the helmet or another component to provide for tightening and/or loosening, or may comprise all or part of a belt that fits completely around the user's head.

Dial 130 may be rotated in one direction to tighten the fit system, and in a second direction to loosen the fit system. In some embodiments, dial 130 may be rotated in a clockwise direction 170 for tightening and a counterclockwise direction for loosening. Other embodiments may rotate in clockwise direction for tightening and a counterclockwise direction for loosening. Dial 130 may comprise any appropriate size or shape. In this example, dial 130 is generally cylindrical and may comprise one or more ridges on the outside wall to provide a better grip for a user. In one embodiment, adjustment mechanism 112 comprises actuator 132 situated at least partially within dial 130. Actuator 132 is generally cylindrical in this example but may be configured in any suitable shape.

When dial 130 is rotated clockwise to tighten the fit system, actuator 132 may also rotate clockwise. As described in detail with respect to FIGS. 4-6, a first set of teeth on base 140 may engage a second set of teeth on actuator 132 and allow actuator 132 to rotate clockwise but not counterclockwise. The first set of teeth on base 140 and/or the second set of teeth on actuator 132 may be angled to allow movement in only one direction. As also described in FIGS. 4-6, actuator 132 may comprise a pinion comprising a third set of teeth, which may tighten a rack beneath base 140 coupled to arms 108. When the rack is tightened, arms 108 pull the fit system for a tighter fit. In other embodiments, actuator 132 may comprise a drum in a cable and drum system, or may comprise any other suitable component.

Dial 130 may be rotated counterclockwise in this example to loosen the fit system. When dial 130 is rotated counterclockwise, a drive-dog, as described below, on actuator 132 may lift actuator 132 and disengage the second set of teeth of actuator 132 from the first set of teeth on base 140, allowing actuator 132, configured as a pinion in this example, to rotate counterclockwise and loosen the fit system via the rack and arms 108. Actuator 132 may also retain the fit at any stopping point during loosening, which allows adjustment mechanism 112 to be loosened incrementally. Further details of this mechanism can be found in the discussion of FIGS. 4-6.

Arms 108 may be comprised of any suitable material and configured in any suitable shape. Arms 108 and adjustment mechanism 112 may generally function to adjust the effective circumference of a helmet 110 around a user's head. In certain embodiments, as shown here, arms 108 may represent two sides of a band or belt that spans the circumference of a user's head. Arms 108 may be attached to helmet 110 in one or more locations to properly position arms 108 within helmet 110.

As illustrated in FIG. 2, arms 108 generally extend along the lateral portions of helmet body 110 and converge at adjustment mechanism 112. In the illustrated embodiment, arms 108 comprise a band located around the inside of helmet 110. In certain other embodiments, the end of each arm 108 may include a post that may be snap fitted into one or more recesses (not illustrated) in an interior portion of helmet 110. When engaged with the recess of helmet body 110, the post may be able to rotate about the recess. Using a snap-fit or other releasable retention means for connecting may reduce assembly time and manufacturing costs associated with helmet 110.

Adjustment mechanism 112 may extend or retract arms 108 by rotation of dial 130. Such adjustment may adjust the circumference of arms 108 to more properly fit on a user's head. One or more racks (not shown) comprising a rack and pinion system may be coupled to arms 108 or may be formed as part of arms 108. Rotation of dial 130 may rotate a pinion that loosens or tightens a rack associated with arms 108, as described in further detail below with respect to FIGS. 4-6. In other embodiments, rotation of dial 130 may rotate a cable in a cable and drum system that loosens or tightens arms 108 to adjust fit. In other embodiments, other mechanisms may be used to adjust fit.

The fit system of helmet 110 may include retention straps 103*a-b* that generally function to secure helmet 110 to the head of a user. According to one embodiment, retention straps 103*a-b* may be coupled together to form a loop under the chin of a user. In certain embodiments, either a single retention strap 103, or both straps 103*a-b*, may include an adjustment mechanism to regulate the length of the retention strap. Increasing or decreasing the length of a strap 103 may allow the fit system to securely attach helmet 110 to heads of different shapes and sizes.

In the illustrated embodiment, retention straps 103 include a front strap 105, a rear strap 107, and a chin strap 109 that converge at a strap separator 113. Front straps 105 may be coupled to helmet 110 proximate a front portion of helmet 110 via front anchor points (not shown). Anchor points may generally be any suitable mechanism or device for securing a component to helmet 110.

In certain embodiments, retention straps 103*a-b* may share a common rear strap 107. Rear strap 107 may connect retention straps 103*a-b* to a hanger 123 which may be anchored to helmet 110 in any suitable location Sharing a common rear strap 107 may reduce the number of anchor points needed to couple the fit system to helmet 110. Because anchor points may be areas of increased stress, they generally require greater structural support in the form of a specific device or dense material in the surrounding region. Accordingly, reducing the number of anchor points may reduce the weight of helmet 110 and allow for increased design flexibility.

Each chin strap 109 may generally extend from strap separator 113 to either a male or female portion of a buckle 115. Fastening buckle 115 may form a loop which may be positioned beneath the chin of the user. In certain embodiments, either or both strap separators 113 may be operable to adjust the length of a chin strap 109*a-b* thereby allowing for the tightening or loosening of retention straps 103*a-b* around the head of a user. Permitting such adjustment may assist and/or facilitate the positioning of chin straps 109 in an optimum location for securing helmet 110 to a user's head.

While a particular fit system for helmet 110 is shown, various modifications, and substitutions, or alterations may be made. For example, embodiments of the fit system may include multiple rear straps 107 that each connect to helmet 110 at separate anchor points. Helmet 110 may also comprise padding 121 inside helmet 110. Padding 121 may comprise any suitable material and be situated in any suitable manner. Padding 121 may comprise one piece or multiple pieces, and may be removable or adjustable in certain embodiments.

Figure 3:
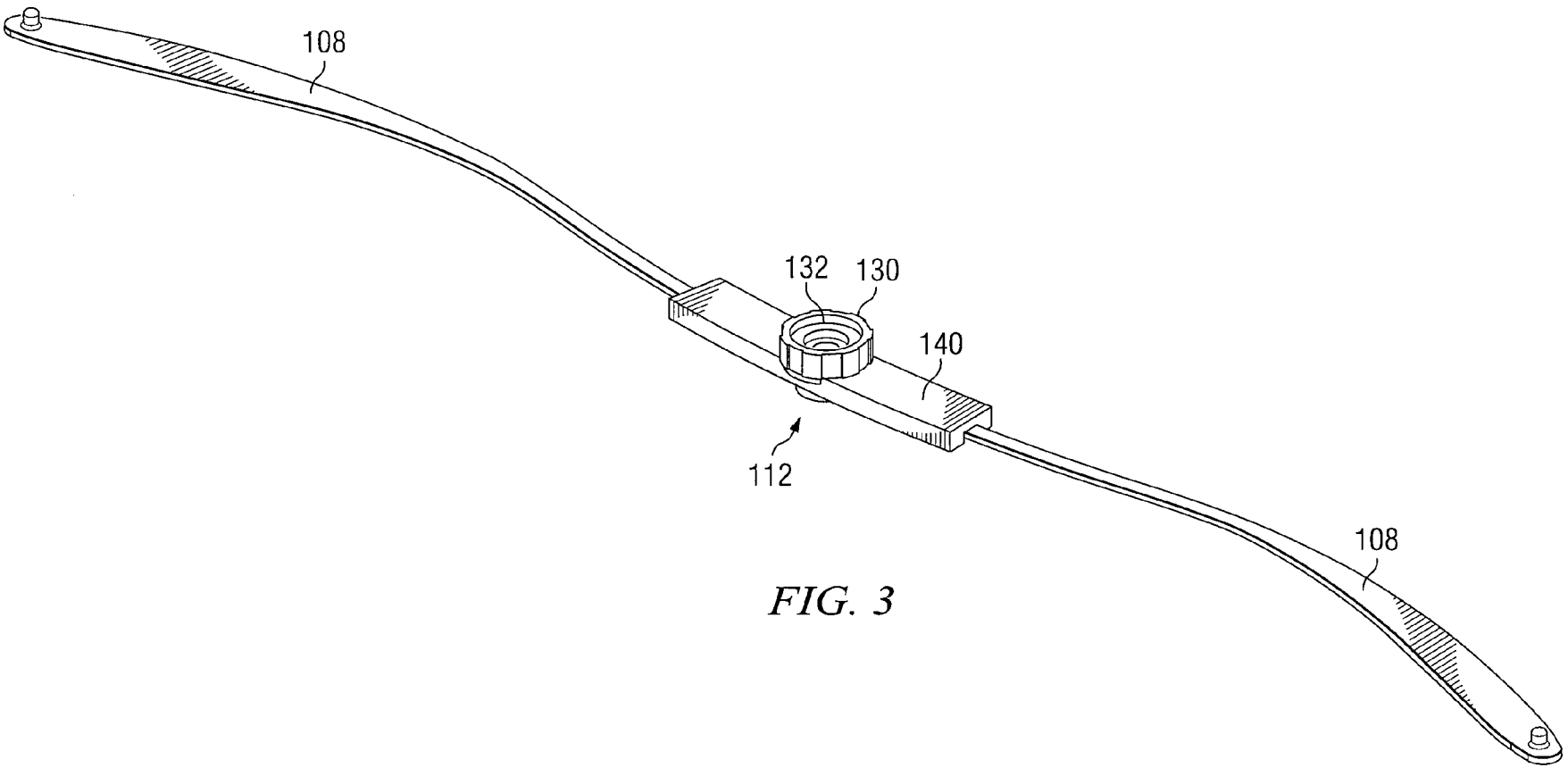
FIG. 3 illustrates one view of an adjustment mechanism in accordance with one example embodiment.

FIG. 3 illustrates one view of adjustment mechanism 112. Adjustment mechanism 112 comprises dial 130, actuator 132, and base 140. Other components of adjustment mechanism 112 may be obscured or partially obscured in this figure. Arms 108 are also shown in FIG. 3. Adjustment mechanism 112 is configured to tighten and/or loosen a fit system. The fit system may be used in a variety of applications, like a helmet, shoes, or other equipment. The fit system may also allow incremental loosening and tightening.

FIG. 3 illustrates adjustment mechanism 112 separate from a specific application. Adjustment mechanism 112 may be altered in a variety of ways for use in other embodiments. As one example, adjustment mechanism 112 may be made smaller or larger depending on the details of the embodiment. Adjustment mechanism 112 may be smaller if used on laces for tightening boots than if it is used on a bicycle helmet. As another example, arms 108 may comprise plastic straps if used on helmet, but may comprise leather or another material if used to fit shoes or boots. In addition, base 140 may be larger or smaller relative to dial 130 and actuator 132 as shown, depending on the embodiment. The rack within base 140 may be shorter or longer in other embodiments. The length and/or width of arms 108 may also be adjusted depending on the embodiment.

Figure 4:
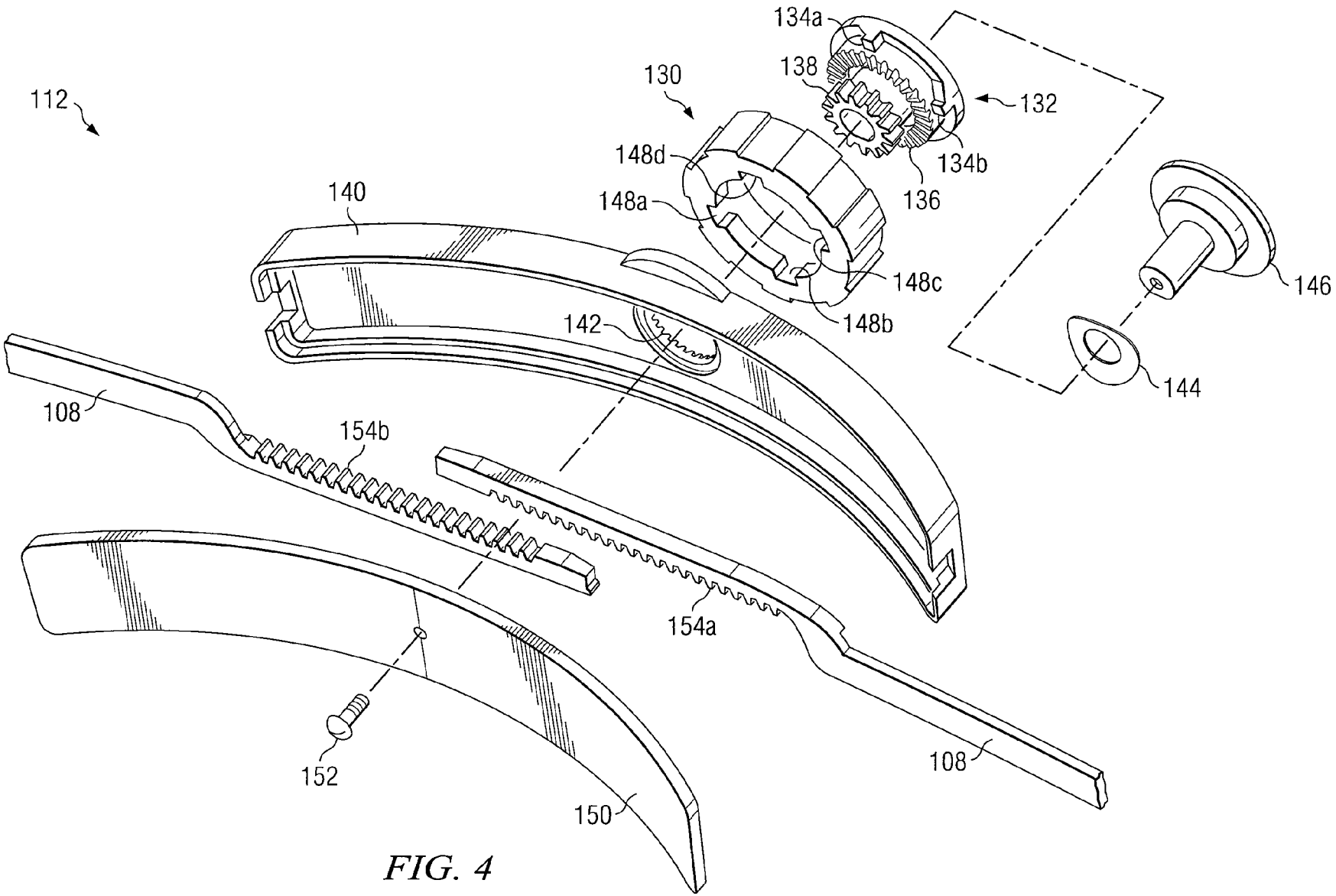
FIG. 4 illustrates an exploded view of an adjustment mechanism in accordance with one example embodiment.

FIG. 4 illustrates an exploded view of an adjustment mechanism 112 in accordance with one example embodiment. Adjustment mechanism 112 may comprise cap 146, spring 144, actuator 132, dial 130, base 140, racks 154*a* and 154*b*, base 150, and screw 152. In this embodiment, actuator 132 is configured with a set of teeth 138 to operate as a pinion in conjunction with racks 154*a* and 154*b*. In other embodiments, actuator 132 may be a drum operable to tighten and/or loosen one or more cables to adjust the fit system. In yet another embodiment, actuator 132 may comprise a part of a screw and nut mechanism for tightening and/or loosening. In any of these alternative embodiments, actuator 132 may allow for incremental release of tension when dial 130 is rotated. Other components utilized in the operation of those mechanisms may also be present in other embodiments.

Adjustment mechanism 112 may be configured to tighten a fit system when dial 130 is rotated in one direction and loosen a fit system when dial 130 is rotated in another direction. Adjustment mechanism 112 may tighten the fit system when the dial is rotated clockwise, as viewed when facing dial 130, and loosen the fit system when the dial is rotated counterclockwise. Racks 154*a* and 154*b* and actuator 132 may adjust the fit system when dial 130 is rotated. Arms 108 may extend from racks 154 on each side through one or more holes in base 140. Arms 108 may comprise a portion of a fit system that is adjustable in length to either loosen or tighten the fit system. For example, arms 108 may comprise straps that couple to a helmet worn for protection, such as a bicycle helmet. In other embodiments, arms 108 may comprise laces for a shoe or boot, and adjustment mechanism 112 may be used to tighten and/or loosen the laces.

Teeth 138 on actuator 132 may engage racks 154*a* and 154*b* and tighten the fit system when dial 130 is rotated in a first direction. Drive-dogs 134*a* and 134*b* on actuator 132 may engage cutouts 148*a*-148*d* on dial 130. Although only two drive-dogs 134 are visible in FIG. 4, additional drive-dogs may be formed on the non-visible side of actuator 132 so that each cutout 148 in dial 130 engages a corresponding drive-dog 134. These drive-dogs 134 allow actuator 132 to rotate in the first direction when dial 130 rotates in the first direction. In other embodiments, any suitable number of drive-dogs 134 and/or cutouts 148 may be used.

When adjustment mechanism 112 is assembled, teeth 136 on actuator 132 engage teeth 142 on base 140. In some embodiments, one or both sets of teeth 136 and teeth 142 may be angled so that actuator 132 may only rotate in one direction while these teeth are engaged. When dial 130 is rotated in the first direction, actuator 132 is rotated in the first direction as well and teeth 136 advance in the first direction. Teeth 138 on actuator 132 also advance, which tightens rack 154 and pulls arms 108 closer together, tightening the fit system.

When dial 130 is rotated in the second direction, the angled edges of drive-dogs 134 engage the edges of cutouts 148 on the inner wall of dial 130. The angled edges lift actuator 132 away from dial 130 and base 140. This lifting movement allows teeth 136 of actuator 132 to disengage from teeth 142 on base 140. Once these teeth have disengaged, actuator 132 is free to rotate in the second direction as well as the first direction. Teeth 138 on actuator 132 are still engaged with racks 154, however, and the rotation in the second direction loosens the fit system by loosening racks 154 and arms 108. The fit system may be loosened incrementally based on how far the dial is rotated, with retention of the fit at any stopping point. In addition, the design of adjustment mechanism 112 further provides for holding a selected fit in place by the interlocking teeth 136 and 142. These sets of teeth prevent actuator 132 from slipping and loosening arms 108 at a time when the user does not want to loosen the fit system.

Adjustment mechanism 112 in this embodiment further comprises cap 146 and screw 152. These components may be used to hold other components of adjustment mechanism 112 together. Holes for screw 152 can be seen in bottom 150 and cap 146. When screw 152 is inserted and tightened, other components of mechanism 112 may be held in their appropriate places. Spring 144 may also be used in some embodiments to help compress components together. Spring 144 may be located near actuator 132, as shown, or may be located elsewhere in other embodiments. Some embodiments may not utilize a spring, and other embodiments may utilize components different than cap 146 and screw 152 to couple components together.

Base 140 and bottom 150 may be used in some embodiments to couple one or more components together, or house one or more components, in adjustment mechanism 112. Base 140 and bottom 150 may comprise any suitable size and shape for use in adjustment mechanism 112. Base 140 and bottom 150 may be comprised of any suitable material. Racks 154 may reside within base 140 and bottom 150 when adjustment mechanism 112 is held together with screw 152 and cap 146. Arms 108 may extend from racks 154 on each side through one or more holes in base 140. Arms 108 may comprise a portion of a fit system that is adjustable in length to either loosen or tighten the fit system. For example, arms 108 may comprise straps that couple to a helmet worn for protection, such as a bicycle helmet. In other embodiments, arms 108 may comprise laces for a shoe or boot, and adjustment mechanism 112 may be used to tighten and/or loosen the laces. Adjustment mechanism 112 may be used in embodiments other than helmets or shoes as well.

Figure 5:
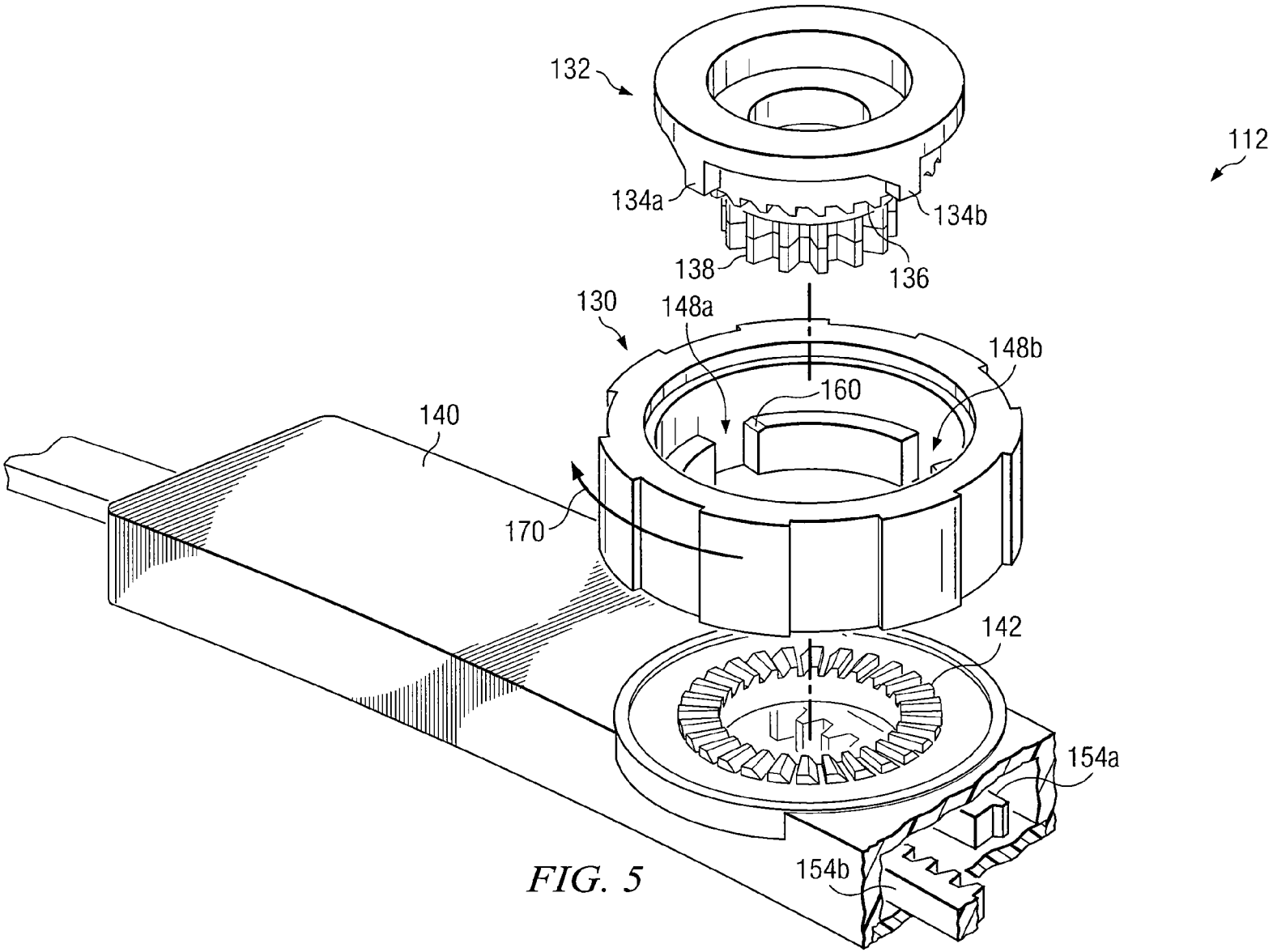
FIG. 5 illustrates an exploded view of some of the components of an adjustment mechanism in accordance with one example embodiment.

FIG. 5 illustrates another view of one embodiment of an adjustment mechanism 112. FIG. 5 illustrates actuator 132, dial 130, and base 140. A close-up view of drive-dogs 134*a* and 134*b*, teeth 136, teeth 138, and teeth 142 can be seen in FIG. 5. Cutouts 148*a* and 148*b* can be seen in dial 130. Other cutouts 148 may also be found in dial 130 in this embodiment or other embodiments. Drive-dogs 134 are configured to fit within cutouts 148 when actuator 132 is inserted into dial 130. Drive-dogs 134 and cutouts 148 are configured to allow dial 130 and actuator 132 to rotate in the same direction when dial 130 is rotated in a first direction to tighten the adjustment mechanism. In this example, dial 130 is rotated clockwise in direction 170 to tighten the adjustment mechanism and counterclockwise to loosen the adjustment mechanism. In this embodiment, actuator 132 comprises a pinion with teeth operable to engage a rack used to tighten and/or loosen the fit system. Other embodiments may comprise an actuator 132 that is configured to be a part of a cable and drum system, a band and drum system, a worm and gear system, a screw and nut system, or any other suitable mechanism. Other components utilized in the operation of those mechanisms may also be present in other embodiments.

When dial 130 is rotated counterclockwise, the angle of drive-dogs 134 allows drive-dogs 134 to drive actuator 132 away from base 140, and allows teeth 136 of actuator 132 to disengage teeth 142 of base 140. Dial 130 may further comprise slanted edge 160 in some embodiments. Slanted edge 160 is configured to allow drive-dogs 134 to more easily lift actuator 132 when dial 130 is rotated in the second direction. When dial 130 is rotated counterclockwise and teeth 136 disengage from teeth 142, actuator 132 is free to also rotate counterclockwise. When actuator 132 rotates counterclockwise, teeth 138 also rotate and loosen racks 154*a*-*b* configured to operate with actuator 132. The loosening of racks 154*a*-*b* allows loosening of a fit system associated with the racks. The fit system may be coupled to a helmet, shoes, boots, or other equipment and used to tighten and/or loosen fit in various embodiments. The fit system may also allow for retention at any stopping point when tightening and/or loosening the fit system.

Figure 6:
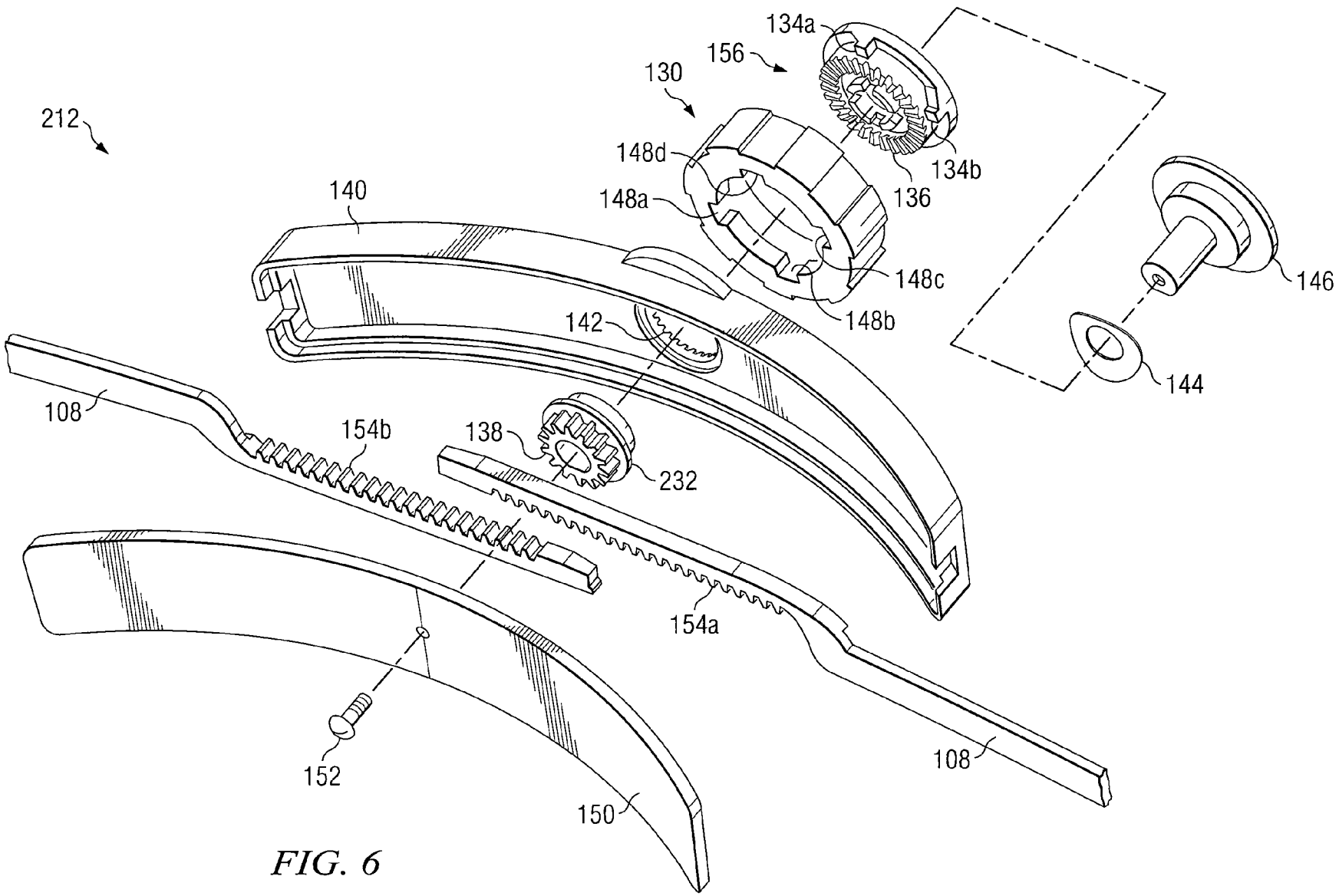
FIG. 6 illustrates an exploded view of an adjustment mechanism in accordance with another example embodiment.

FIG. 6 illustrates an exploded view of an adjustment mechanism 212 in accordance with another example embodiment. Adjustment mechanism 212 may comprise cap 146, spring 144, actuator 232, dial 130, shuttle 156, base 140, arms 108, racks 154*a* and 154*b*, bottom 150, and screw 152. In FIGS. 4-6, like numbers refer to like components. In FIG. 6, adjustment mechanism 212 may be configured to tighten a fit system when dial 130 is rotated in one direction and loosen a fit system when dial 130 is rotated in the other direction. In this embodiment, actuator 232 comprises a pinion with teeth 138 operable to engage racks 154*a* and 154*b*. Racks 154*a* and 154*b* and actuator 232 may be used to adjust the fit system. In other embodiments, actuator 232 may be configured to be a part of a cable and drum system, a band and drum system, a worm and gear system, a screw and nut system, or any other suitable mechanism. Other components utilized in the operation of those mechanisms may also be present in other embodiments. For example, an embodiment where actuator 232 comprises a part of a band and drum system may comprise other components in addition to, or in place of, one or more of the components illustrated in FIG. 6.

Adjustment mechanism 212 works in a substantially similar manner to adjustment mechanism 112 as discussed above with respect to FIGS. 4 and 5. The functionality provided by actuator 132 in FIGS. 4 and 5 is similar to that provided by shuttle 156 and actuator 232 in FIG. 6.

In this embodiment, shuttle 156 and actuator 232 comprise a shared spline feature. The shared spline allows shuttle 156 and actuator 232 to rotate with one another. When dial 130 is rotated in a first direction, both shuttle 156 and actuator 232 will rotate in the first direction. When dial 130 is rotated in a second direction, both shuttle 156 and actuator 232 will rotate in the second direction. Other embodiments may use a mechanism other than a shared spline to allow shuttle 156 and actuator 232 to rotate together.

When dial 130 is rotated in the first direction, shuttle 156 and actuator 232 are rotated in the first direction as well and teeth 136 rotate in the first direction. Teeth 138 on actuator 232 also rotate, which tightens rack 154 and pulls arms 108 closer together, tightening the fit system.

Drive-dogs 134*a* and 134*b* (and any other drive-dogs 134 not visible) on shuttle 156 may engage cutouts 148*a*-148*d* on dial 130. These drive-dogs 134 allow shuttle 156 (and actuator 232) to rotate in the first direction when dial 130 rotates in the first direction.

When dial 130 is rotated in the second direction, the angled edges of drive-dogs 134 engage the edges of cutouts 148 on the inner wall of dial 130. The angled edges lift shuttle 156 away from dial 130 and base 140. This lifting movement allows teeth 136 of shuttle 156 to disengage from teeth 142 on base 140. Once these teeth have disengaged, shuttle 156 and actuator 232 are free to rotate in the second direction as well as the first. Teeth 138 on actuator 232 are still engaged with racks 154, so the rotation in the second direction loosens the fit system by loosening racks 154 and arms 108. The shape and structure of drive-dogs 134 allow dial 130 to be used to either tighten or loosen a fit system. In addition, the design of adjustment mechanism 212 further provides for holding a selected fit length in place by interlocking teeth 136 and 142. The fit system can thus be loosened or tightened incrementally without completely releasing the tension.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An adjustment mechanism, comprising:

a generally cylindrical dial comprising an inner wall defining a hole passing through the dial, the inner wall comprising a ledge having one or more cutouts;

a base comprising a first set of teeth; an actuator comprising a second set of teeth, the second set of teeth configured to engage the first set of teeth and allow the actuator to be rotated in a first direction but not in a second opposite direction;

the actuator further comprising one or more drive-dogs, each drive-dog configured to engage a cutout on the inner wall of the dial, each drive-dog comprising a ramped edge configured to disengage the drive-dog from the cutout and to lift the second set of teeth of the actuator from the first set of teeth of the base when the dial is rotated in the second direction; and wherein the actuator is configured to tighten an adjusted mechanism when the dial is rotated in the first direction and loosen the adjusted mechanism when the dial is rotated in the second direction.

2. The mechanism of claim 1, wherein the adjusted mechanism is a rack, and the actuator comprises a pinion comprising a third set of teeth configured to engage the rack.

3. The mechanism of claim 1, wherein the ledge further comprises one or more notches associated with each of the one or more cutouts, the one or more notches configured to allow the ramped edge of the drive-dog to disengage from the cutout.

4. The mechanism of claim 2, wherein the base comprises a cover for the rack.

5. The mechanism of claim 2, wherein the actuator is configured to tighten the rack when the dial is rotated in the first direction and loosen the rack when the dial is rotated in the second direction.

6. The mechanism of claim 2, wherein the rack and actuator comprise a portion of a helmet fit system and are used to adjust the helmet fit system.

7. The mechanism of claim 2, wherein the rack and actuator comprise a portion of a shoe fit system and are used to adjust the shoe fit system.

8. The mechanism of claim 1, further comprising a spring positioned adjacent to the actuator and configured to compress the actuator against the base.

9. The mechanism of claim 2, wherein the rack comprises a row of gear teeth, wherein the gear teeth are coupled to a plurality of arms, each of the plurality of arms attached to a helmet, and wherein the arms are configured to tighten a fit system of the helmet when the dial is rotated in the first direction.

10. The mechanism of claim 9, wherein the arms are configured to loosen the fit system when the dial is rotated in the second direction.

11. The mechanism of claim 1, wherein the adjusted mechanism is one or more cables, and the actuator comprises a drum configured to engage the one or more cables, wherein the one or more cables are configured to tighten a fit system when the dial is rotated in the first direction.

12. An adjustment mechanism, comprising:

a generally cylindrical dial comprising an inner wall defining a hole passing through the dial, the inner wall comprising a ledge having one or more cutouts;

a base comprising a first set of teeth;

a cylindrical shuttle comprising a second set of teeth, the second set of teeth configured to engage the first set of teeth of the base and allow an actuator coupled to the shuttle to be rotated in a first direction but not in a second opposite direction;

the shuttle further comprising one or more drive-dogs, each drive-dog configured to engage a cutout on the inner wall of the dial, each drive-dog comprising a ramped edge configured to disengage the drive-dog from the cutout and to lift the second set of teeth of the shuttle from the first set of teeth of the base when the dial is rotated in the second direction; and wherein the actuator is configured to tighten an adjusted mechanism when the dial is rotated in the first direction and loosen the adjusted mechanism when the dial is rotated in the second direction.

13. The mechanism of claim 12, wherein the shuttle and the actuator are configured to rotate together via a shared spline.

14. The mechanism of claim 12, wherein the ledge further comprises one or more notches associated with each of the one or more cutouts, the one or more notches configured to allow the ramped edge of the drive-dog to disengage from the cutout.

15. The mechanism of claim 12, wherein the adjusted mechanism is a rack, and the actuator comprises a pinion comprising a third set of teeth configured to engage the rack.

16. The mechanism of claim 15, wherein the base comprises a cover for the rack.

17. The mechanism of claim 15, wherein the actuator is configured to tighten the rack when the dial is rotated in the first direction and loosen the rack when the dial is rotated in the second direction.

18. The mechanism of claim 15, wherein the rack and actuator comprise a portion of a helmet fit system and are used to adjust the helmet fit system.

19. The mechanism of claim 15, wherein the rack and actuator comprise a portion of a shoe fit system and are used to adjust the shoe fit system.

20. The mechanism of claim 12, further comprising a spring positioned adjacent to the shuttle and configured to compress the shuttle against the base.

21. The mechanism of claim 15, wherein the rack comprises a row of gear teeth, wherein the gear teeth are coupled to a plurality of arms, each of the plurality of arms attached to a helmet, and wherein the arms are configured to tighten a fit system of the helmet when the dial is rotated in the first direction.

22. The mechanism of claim 12, wherein the adjusted mechanism is one or more cables, and the actuator comprises a drum configured to engage the one or more cables, wherein the one or more cables are configured to tighten a fit system when the dial is rotated in the first direction.

* * * * *